US005626020A

United States Patent [19]

Sangster et al.

[11] Patent Number: 5,626,020

[45] Date of Patent: May 6, 1997

[54] MOLECULAR REFRIGERANTS AND COOLING SYSTEMS

[76] Inventors: Bruce F. Sangster, 8252 Delfino Cir., Huntington Beach, Calif. 92646-1605; James D. Bond, 2 Holly, Irvine, Calif. 92715

[21] Appl. No.: 437,430

[22] Filed: May 5, 1995

[51] Int. Cl.[6] ..... F25B 21/00

[52] U.S. Cl. ..... 62/3.1; 62/118; 62/235.1; 62/264

[58] Field of Search ..... 62/3.1, 4, 264, 62/235.1, 118

[56] References Cited

U.S. PATENT DOCUMENTS 5,113,661 5/1992 Deeks ..... 62/3.1
5,165,242 11/1992 Chang ..... 62/3.1
5,177,970 1/1993 Chang ..... 62/3.1
5,447,032 9/1995 Epstein et al. ..... 62/3.1

*Primary Examiner*—Ronald C. Capossela

[57] ABSTRACT

A cooling system is disclosed which utilizes the molecular structural changes of photochromic compounds when they are exposed to various wavelengths of irradiation. Further, a design is disclosed which uses solar irradiation to activate the molecular structural changes. An alternate system of irradiation is disclosed which could be utilized in geographic areas of low incidence of sunlight or during inclement or occluded times in any area. An integrated panel is disclosed for installation on the external face of buildings in order to negate the need for ducting internal to the building. This will significantly increase the efficiency of cooling due to the removal of cooling loss in ducting and the proximity of the cooling system to the cooled space.

6 Claims, 4 Drawing Sheets

MOLECULAR REFRIGERANTS AND COOLING SYSTEMS

BACKGROUND - FIELD OF INVENTION

This invention relates generally to systems and methods for producing refrigerated air for air conditioning, refrigeration and process cooling applications. More specifically, this invention is a completely new approach and replaces refrigerants used in current cooling systems which involve phase changes (gas-liquid) produced by a compressor and the expansion of the compressed refrigerant into a gaseous phase and the associated refrigeration effect. This invention replaces the usual phase change refrigerant with a molecular structural change refrigerant which is activated by solar irradiation.

BACKGROUND - DESCRIPTION OF PRIOR ART

Although no prior art has been identified pertaining to the use of photochromic compounds in cooling systems, there is a substantial body of material on the operation of these compounds, as follows;

Photochromism is best described as; the reversible change of a single chemical compound between two states having distinguishably different molecular structures, with the change induced in at least one direction by the action of electromagnetic radiation(light). The light can be ultraviolet, visible or infrared depending upon the type of compound, and this change is represented by the following equation;

$$A(1) \longleftrightarrow B(2)$$

In this system the change in one direction can sometimes be thermally induced and usually occurs spontaneously. If chemical reactions, stimulated by electromagnetic radiation (light) are irreversible, then these phenomena are classified as ordinary photochemistry.

Photochromic behavior is differentiated from the normal chemical reaction process by the type of excitation given the molecules. Considering the A to B conversion, certain wavelengths of radiation will excite A. Each quantum (packet) of radiation absorbed by the photochrome creates an excited molecule. The exciting radiation must be of sufficient energy to activate the photochromic molecule so that it will pass over the most favorable energy barrier during conversion of A state to B state. This energy barrier, and other energy related parameters (such as thermal barriers) are defined for each particular photochrome, and is effected by the screening and absorbance of the solvents used in solution.

Photochromism occurs in a wide variety of materials, including both organic and inorganic compounds. For the organic compounds, the most frequent activation energy is from ultra-violet (200–400 nm) to the blue region (430 nm) of the spectrum. The spontaneous thermal reversion of the irradiated state to the stable state may take place over time spans ranging from microseconds to hours. Some of the important factors controlling this rate and the structure of the photochromic material, are the temperature of the solution, the viscosity and the polarity of the solvent. As expected, increasing the temperature will increase the rate of conversion.

Although there are many types of photochromic processes, most compounds exhibit one of two major mechanisms; 1) the cleavage or breaking of bonds, and 2) CIS-TRANS isomerization.

In those compounds experiencing cleavage, (spiropyrans are an example) the excitation energy of the photoactivated molecule breaks a single bond leaving "charged segments" of the molecule that exist as isolated ions or may still be connected by other chemical bonds. These "segments" may be relatively stable and unreactive due to their structure and to large extent may recombine thermally to regenerate the original molecule.

CIS-TRANS isomerization generally does not exhibit obvious bond breaking (although there are exceptions) and is a process seen in many living systems. For example, the isomerization of rhodopsin is the primary process in the detection of light by the human retina. In CIS-TRANS isomerization, the TRANS isomer is generally the thermodynamically stable isomer and a thermal(dark) process converts the CIS isomer to the TRANS. There are several examples of compounds where the reversible CIS-TRANS isomerization takes place with excitation from different wavelengths of radiation as well as thermally. The azobenzene group of compounds exhibits this type of photochromism.

OBJECTS AND ADVANTAGES

Accordingly, several objects and advantages of my invention are the photostimulated change in molecular structure of a class of photochromic compounds, which change is reversible by either a wavelength of light or a heat gradient. This class of compounds produces a heat absorption capability which varies by specific molecular structure and the solvent being used to place the molecule in solution.

One aspect of this invention features the use of a compounds which absorbs a large heat capacity during its molecular change and does so spontaneously, thereby providing a direct mechanism for a cooling loop in an air conditioner. This compound is stimulated to its reversible molecular change by exposure to sunlight. This solar irradiated cooling system requires far less in mechanical energy than the standard phase change compressor driven system.

Another aspect of this invention features the inclusion of an artificial irradiation system to activate the above molecular changes in geographic areas that are occluded from solar light or in enclosed systems.

In one embodiment, a photochromic compound of smaller heat capacity is utilized in a plurality of heat exchangers to successively remove heat from the air flow through the heat exchanger. This design will provide the capability to freeze or refrigerate food, The molecular change in the release of heat is activated by solar irradiation thereby greatly increasing the mechanical efficiency of the refrigerator compared to the standard phase change refrigerator.

This refrigerator system can also utilize a light irradiation source internal to the refrigerator if the design does not permit access to visible light. This system will still maintain a significant operating efficiency over the standard phase change system.

A preferred embodiment for the use of these compounds in an air conditioning system is comprised of an integrated panel incorporating the heat exchangers for both heat absorption and heat release and air flow heat transfer mechanisms. The panel is intended to be physically located on the external facia of a commercial or residential building with one transparent window to provide solar irradiation to the heat exchanger for heat release. In this design, the air is drawn into the panel from the room and forced through the heat exchanger for cooling and then forced directly into the room to cool the immediate area. No extended ducting is necessary thereby removing any cooling losses due to transport. The heat exchanger for removal of heat forces air directly out of the panel to the outside for dissipation. The panel can be made small enough to cool individual rooms to the personal comfort of each person residing in that room, without the necessity for ducting the cooled air. The molecular change will be accomplished utilizing solar irradiation thereby providing the high level of efficiency from the original embodiment.

Still further objects and advantages will become apparent from a consideration of the ensuing description and accompanying drawings.

REFERENCE NUMERALS - DRAWINGS

Figure 1:
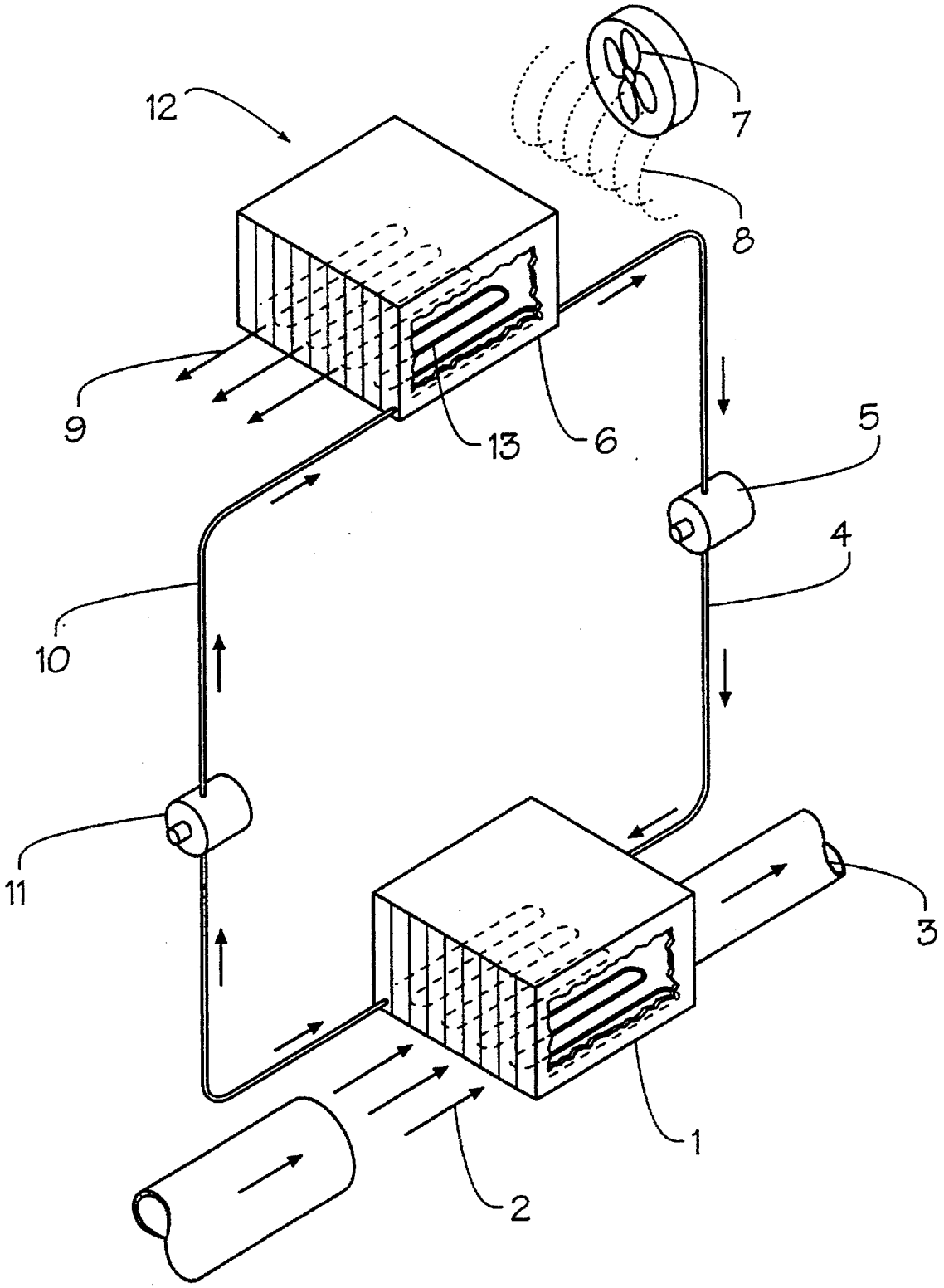
FIG. 1 is a schematic showing the operation of this invention in an embodiment which utilizes solar irradiation to activate the invention.

FORMAL DRAWINGS FIGS. 1–4:

FIG. 1:

1 Heat exchanger to absorb heat
2 Hot air flow from rooms to be cooled
3 Cooled air flow to ducting
4 Photochromic solution in molecular structure #1
5 Liquid handling pump
6 Heat exchanger to release heat
7 Electrically powered fan for air flow.
8 Cooling water to reduce air temperature.
9 Hot air flow to outside.
10 Photochromic solution in molecular structure #2.
11 Liquid handling pump.
12 Solar irradiation (visible).
13 Detail of heat exchanger tubes for flow of photochromic solution.

FIG. 2;

Numbers 1–11 identical to FIG. 1.
12 Electrical power for light source.
13 identical to FIG. 1.
14 Light source.
15 Secondary cooling heat exchanger
16 Cool water from water main.

FIG. 3;

1 Heat exchanger to absorb heat.
2 Heat exchanger to absorb heat.
3 Heat exchanger to absorb heat.
4 Photochromic solution in molecular structure #1 .
5 U-V irradiation source.
6 Cooled air flow.
7 Cooled air flow to freezer compartment.
8 Electrically powered fan.
9 Photochromic solution in molecular structure #2.
10. Hot air flow
11 liquid handling pump.
12 Liquid handling pump.
13 Detail of heat exchanger tubes for flow of photochromic solution.
14 Electrically powered fan.
15 Hot air flow.
16 Heat exchanger to release heat.
17 Solar irradiation

FIG. 4;

1 Panel structure encasing system.
2 Transparent window for light irradiation.
3 Hot air flow.
4 Mounting surface to external facia of building.
5 Ducting for heat exchanger to external vent.
6 Internal side of vent #3.
7 Vent to collect air from space to be cooled.
8 Heat exchanger to release heat.
9 Photochromic solution in molecular structure #1.
10 Photochromic solution in molecular structure #2.
11 Liquid handling pump.
12 Liquid handling pump.
13 Heat exchanger to absorb heat.
14 Ducting for cooled air to vent.
15 Cooled air vent.

SUMMARY

The principal objective of this invention is to provide an molecular refrigerant for cooling systems which is activated by light irradiation.

It is another objective of this invention to provide a cooling system which can be integrated into the walls or ceilings of buildings thereby removing the need for the ducting of the air flow.

It is another objective of this invention to provide cooling systems whose operating efficiency is substantially increased over the standard phase change refrigerant system, and thereby reducing energy required for cooling with one result a reduction in fossil fuel usage.

PREFERRED EMBODIMENT - DESCRIPTION

FIG. 1 illustrates the major components of a system for air conditioning a building in accordance with the invention. The components include a heat exchanger (6) with a transparent top to be mounted on the rooftop or external to the building. The external placement will permit the photochromic solution being pumped through the heat exchanger to be irradiated with solar irradiation. The second heat exchanger (1) will be located internal to the building and will be connected to ducting which will carry the cooled air through the remaining portions of the building. Pumps (5) and (11) are to pump a photochromic solution, such as [Spiropyran Analog] at an appropriate flow rate to allow the molecular transformations occurring in the heat exchanger to optimally absorb or release heat. Based on thermostatic control, the photochromic solution would be pumped into the heat exchanger (1) where the hot air being forced by ducting fans will create a temperature differential which will activate the molecular structural change in the photochromic solution and absorb the heat from the ducted air. The cooled air will then be ducted to the areas or spaces to be cooled. The photochromic solution is then pumped to the heat exchanger (6), where it is exposed to solar irradiation (visible), which causes the photochromic solution to reverse its molecular structure. When this molecular structural change occurs the solution will release its absorbed heat. Airflow from electricaly powered fans will force the hot air flow outside the heat exchanger for blending with outside air. Pump (11) then props the photochromic solution to heat exchanger (1) for cooling.

Figure 2:
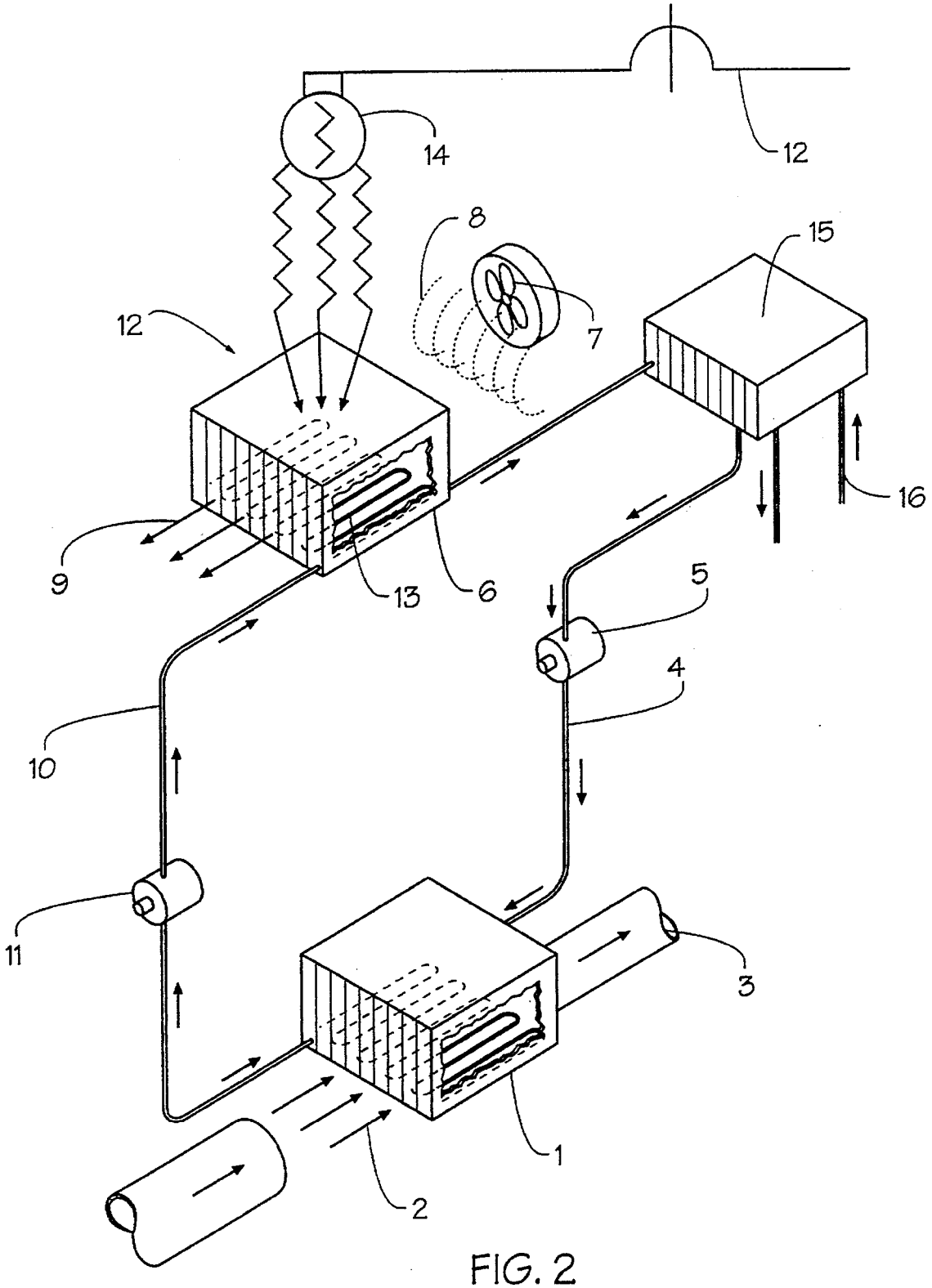
FIG. 2 is a schematic showing the operation of the invention in an embodiment which utilizes an electrically powered source of light to activate the invention.

An alternative processing cycle is shown in FIG. 2. In areas where solar irradiation is not available or during periods of inclement weather, the embodiment shown in FIG. 2 would provide a mode of photoactivated cooling. An electrically powered mercury arc lamp (14) would provide the photonic energy to stimulate the molecular structural change in heat exchanger (6). In areas where there are extremely hot temperatures (>100 degrees F), it may be necessary to cool the outlet temperature of the photochromic solution with a secondary heat exchanger (15), as shown in FIG. 2. In those instances the secondary heat exchanger would have fresh cool water from the normal water main to reduce the operating temperture of the solution. All other components in this embodiment would be the same as the first embodiment.

Figure 3:
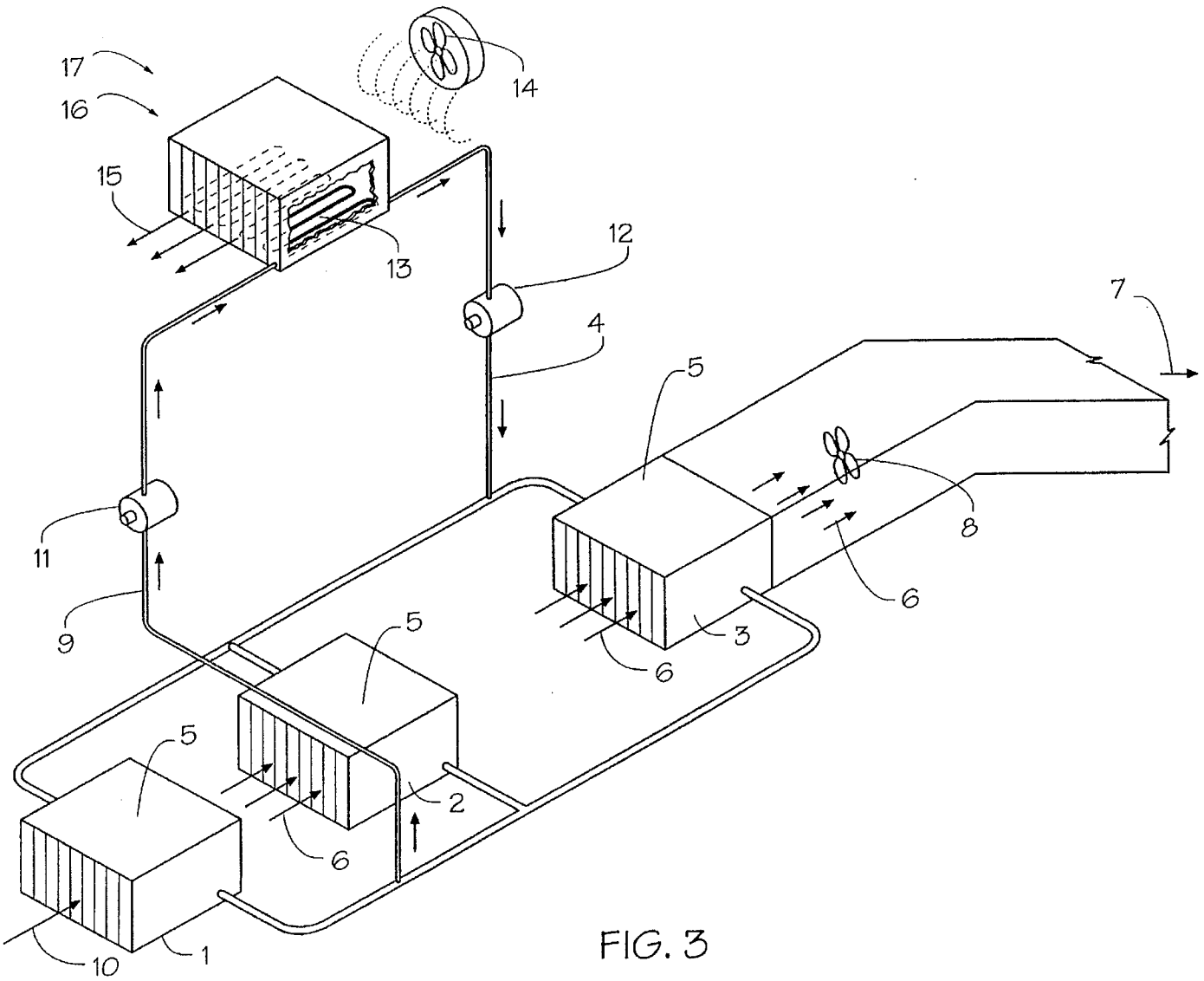
FIG. 3 is a schematic showing the operation of the invention in an embodiment which uses a plurality of heat exchangers to effect a larger temperature drop in order to freeze food.

FIG. 3 illustrates the major components of a system for food refrigeration and freezing. For air conditioning systems, the temperature differential from hot inlet air to cool outlet air is normally designed for 20 degrees F. The kinetics of the molecular changes of some compounds allow for the design flow rates for this photochromic solution to be easily obtained with off the shelf hardware. The time for molecular transformations also provide design criteria which match well with the flow rates through the heat exchanger. However, the temperature differential required for a food refrigerator and freezer system are beyond this design criteria for the exchanger for some compounds such as [Spiropyran Analog]. The kinetics of this compound are not fast enough to allow for the flow rate necessary for the temperature differential of the food freezer. Therefore, in order to produce a refrigeration capacity which would meet food compartment standards, a more rapid transformation and smaller incremental heat capacity is required. In FIG. 3, a photochromic refrigerant solution, such as [Spiropyran, 7 Nitro Bips] is utilized in a plurality of heat exchangers, 1,2,3 . . . N, to effect the temperature differential for a food freezer. In this embodiment, the air is successively cooled in the sequence: of heat exchangers, 1,2,3, . . . N. The molecular structural change is activated by U-V wavelengths. Once this molecular structural change is activated by U-V irradiation, it will absorb the heat from the air flow and it will be passed to the next heat exchanger for additional heat removal. In this manner a temperature differential of 35 degrees F can be achieved. The pump (11) then pumps the photochromic solution to the rooftop or external location for the release of its heat to the atmosphere by exposure to visible light. Pump(12) then pumps the photochromic solution to heat exchangers 1,2,3, . . . . N for further cooling as required by thermostatic control.

If the above embodiment is only feasible in a closed system, then the source of irradiation can be provided by electrically powered light sources, visible for heat exchanger (16) and U-V for heat exchangers 1,2,3 . . . N.

Figure 4:
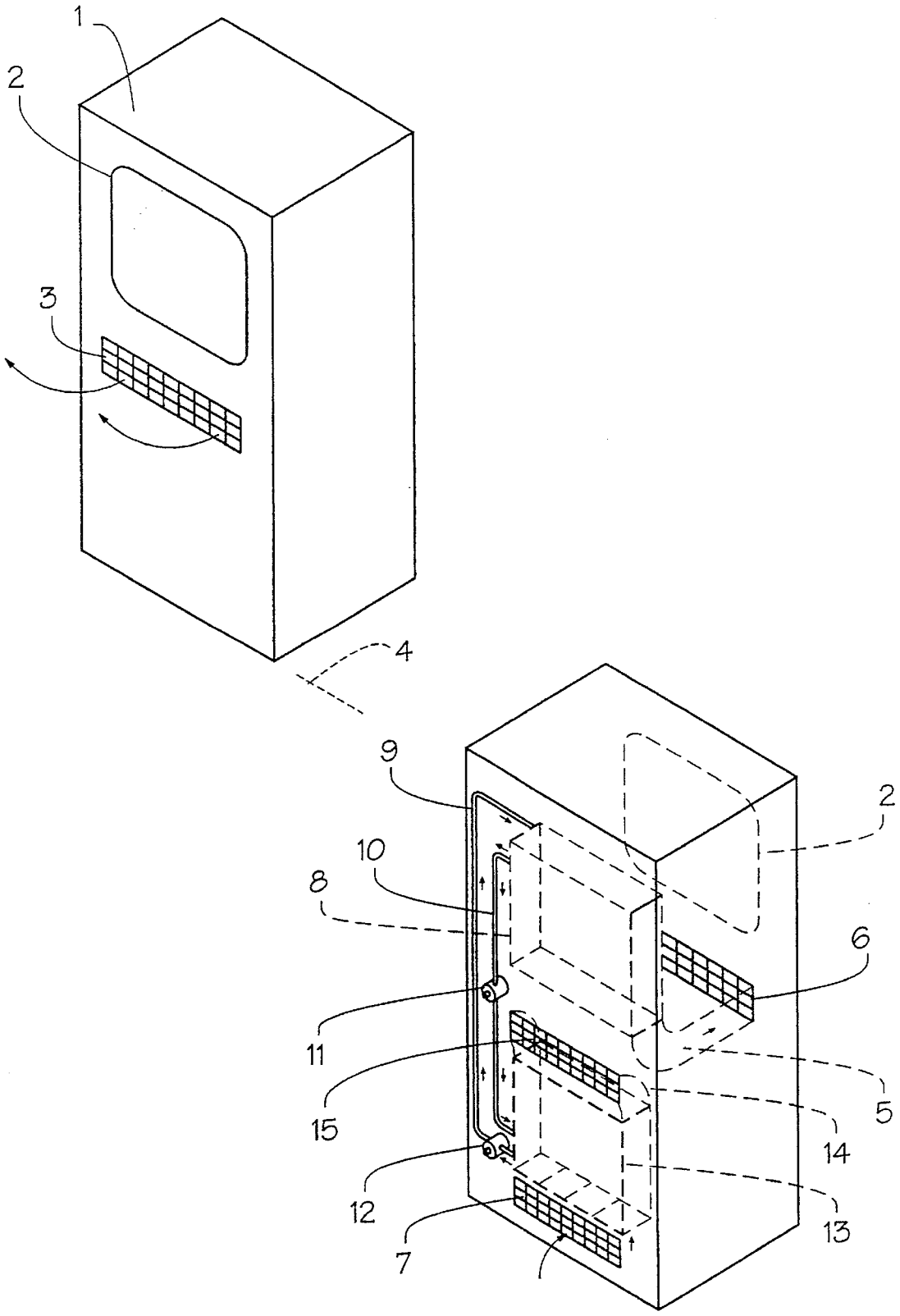
FIG. 4 is a schematic showing the operation of the invention in an embodiment which provides cooling directly into a room without using the central ducting in use in most buildings.

FIG. 4 illustrates the preferred embodiment for the invention. The major components of an integrated cooling panel for use in commercial or residential buildings is shown in FIG. 4. The panel is designed to cool the immediate room or area to the personal comfort of the persons residing in that room. A commercial buidling would have many of these integrated panels installed on the outside walls and each individual room could be thermostatically controlled.

The integrated panel incorporates a sealed transparent window which will allow visible light to enter and irradiate heat exchanger (8). The photochromic solution [Spiropyran Analog] would then give up its heat and fans would force the hot air through ducting (5) to the external vent (6) and outside. The heat exchanger (8) would have a transparent top as previously shown. The photochromic solution would be pumped to heat exchanger (13), where hot air is pulled in from the room space and is cooled by the molecular structural change and is then forced out by electrical fans. The system would be thermostatically controlled and as shown in FIG. 4, would remove the need for ducting the cooled air through the building, thereby increasing efficiency.

CONCLUSION, RAMIFICATIONS, AND SCOPE

Accordingly, it can be seen that the invention provides a substantial advantage in operating efficiency over the standard phase change refrigeration and air conditioning systems. Because of tis inherent use of solar energy to drive the molecular transitions of the molecules, it is also provides significant benefits for the reduction of the use of fossil fuels for electrical power and the associated benefits for environmental quality.

Although the description above contains many specificities, these should not be construed as limiting the scope of the invention but as merely providing illustrations of some of the presently preferred embodiments of this invention. Various other embodiments and ramifications are possible within it's scope. For example, the use of the system as integral part of the external walls of both residential and commercial buildings.

Thus the scope of the invention should be determined by the appended claims and their legal equivalents, rather than by the examples given.

What is claimed is:

1. A refrigeration system employing a light sensitive heat transfer medium for cooling a space comprising:

a fluid conduit means for conveying said medium between a first area to be cooled by said system and a second area where the captured heat will be exchanged;

means for pumping said medium through said conduit means;

a first heat exchanger means at said first area for absorbing heat from warm air circulating in ducts from said space to be cooled thereby cooling the air;

a second heat exchanger means at said second area for exchanging heat from said medium to the ambient;

means for forcing the cooled air from said first area through said ducts to said space; and meàns for transmitting light energy to said medium at said second area;

wherein the medium when exposed to warm air absorbs heat, said medium is then pumped to said second area where the medium is exposed to light energy and releases heat absorbed from said first area to the medium, said heat in said medium is then released to the ambient through the second heat exchanger means at said second area.

2. A system as in claim 1, with the light energy is provided by solar means.

3. A system as in claim 1, with the light energy is provided by an electrically powered light source.

4. A system as in claim 1, wherein said second heat exchanger means is comprised of a plurality of heat exchangers serially arranged for sequentially removing heat from the warm air at the second area, thereby reducing the temperature to zero degrees centigrade.

5. A system as in claim 1, wherein said medium is encapsulated in a plurality of heat exchange panels positioned on an external wall of said space to be cooled, wherein air cooled by contact with said heat exchange panels is directed into said space.

6. A system as in claim 1, wherein said medium is comprised of a photochromic compound and solvent which when exposed to heat undergoes a first molecular structural change absorbing heat, and when exposed to light energy undergoes a second molecular structural change releasing heat.

* * * * *